US005260550A

United States Patent [19]

Rapp et al.

[11] Patent Number: 5,260,550

[45] Date of Patent: Nov. 9, 1993

[54] PUNCH-TYPE VOTE RECORDING DEVICE

[75] Inventors: Tod A. Rapp, 129 Park Dr., Xenia, Ohio 45385; John W. Donahue, Dayton, Ohio

[73] Assignee: Tod A. Rapp, Xenia, Ohio

[21] Appl. No.: 896,809

[22] Filed: Jun. 9, 1992

Related U.S. Application Data

[62] Division of Ser. No. 557,269, Jul. 24, 1990, abandoned.

[51] Int. Cl.[5] ..... G07C 13/00

[52] U.S. Cl. ..... 235/50 R

[58] Field of Search ..... 235/50 A, 50 R; 225/106, 93; 269/47, 52, 293

[56] References Cited

U.S. PATENT DOCUMENTS

| | | | |
|---|---|---|---|
| 1,613,766 | 1/1927 | Parcher | 83/687 |
| 3,240,409 | 3/1966 | Harris | 235/50 R |
| 3,536,257 | 10/1970 | Laws | 235/50 B |
| 4,297,566 | 10/1981 | Ahmann | 235/50 R |
| 4,488,034 | 12/1984 | Stephens et al. | 235/50 A |
| 4,504,735 | 3/1985 | Thayne | 235/50 A |

OTHER PUBLICATIONS

Patent Application Ser. No. 150,689, Tod Rapp, Feb. 1, 1988.

*Primary Examiner*—Michael L. Gellner
*Assistant Examiner*—Eddie C. Lee
*Attorney, Agent, or Firm*—Biebel & French

[57] ABSTRACT

A punch-type vote recording device for use with a machine-readable non-scored ballot card has a card block mounted in fixed relation to a punch plate and means for biasing the foot of a ballot card against a registration surface on the card block. The arrangement as disclosed eliminates the requirement for high dimensional accuracy in registration pins on the vote recorder and accurately positioned registration apertures in ballot cards. The invention is disclosed in a vote recorder having a slidably received ballot holder comprising a punch plate spaced apart from a guide plate and a card block depending from the guide plate. The punch plate is disclosed as being provided with a series of die openings, each of which has a sharp upturned lip for cooperating with a stylus to shear and cut a precise machine readable hole in the ballot card.

19 Claims, 13 Drawing Sheets

PUNCH-TYPE VOTE RECORDING DEVICE

This is a continuation of copending application, Ser. No. 07/557,269 filed on Jul. 24, 1990, now abandoned.

BACKGROUND OF THE INVENTION

This invention relates to an improved recording device, and more particularly, to an improved punch-type vote recording device for use with a machine-readable non-scored ballot card.

It is well known to provide pre-cored ballot cards for use in conducting an election. Such ballots are inserted into a vote recorder and punched by an appropriate stylus to record voting choices. The perforated scores in such ballots facilitate hand punching by the voters. Typical examples of such prior art are disclosed in Harris U.S. Pat. No. 3,240,409, Laws U.S. Pat. No. 3,536,257 and Ahmann U.S. Pat. No. 4,297,566. While vote recorders of that particular type are relatively easy to operate, they have a disadvantage in that non-separated "chad" sometimes hangs from the edges of the punched openings. This causes tally errors during the vote tabulation process.

One way of avoiding the chad problem is to use non-scored ballot cards in a vote recorder holder such as a vote recorder of the type described in Stephens et al. U.S. Pat. No. 4,488,034. Such a vote recorder may have a housing, a base member mounted to the housing, a resilient mat member mounted to the base member, a lower anvil mounted to the base member adjacent the mat member, an intermediate template member spaced apart from and fixedly mounted to the base member and a slidably mounted upper mask member. The template member has a pattern of guide channels or openings which are in registration with a similar pattern of punch openings in the anvil member. Each punch opening in turn is in registration with a corresponding pair of criss-crossed slits in the mat member. Also , the mask member is provided with a pattern of openings which match the patterns of openings in the template member and the anvil member. However the openings in the mask member are normally out of registration with the other sets of openings, so the mask member normally blocks access to the punch plate. When a ballot card is inserted into the apparatus, the upper mask member is moved from its normal position into an operating position wherein its openings are in registration with the openings in the other members. The ballot card is provided with a pair of registration apertures which are fitted over a pair of card registration pins to lock the card in its fully inserted position. This enables a punch to be inserted through the mask plate, along a guide channel and into working relationship with a punch opening. A voting choice is recorded in the ballot card by forcing the punch against the card and through the underlying punch opening. As a consequence of this action the punch and the anvil cooperatively shear out a chip from the ballot card. The slits in the rubber mat act as finger extensions to grab the severed chip.

Another prior art vote recorder omits the rubber mat and uses a punch having a telescopic sleeve surrounding the punch tip. Again the ballot card is unscored, and an upper template (or mask plate), an intermediate guide plate and a punch plate are provided. In this device the sleeve forces the ballot card against the surface of the punch plate while the punch tip cooperates with the sharp edge around an adjacent punch plate opening to shear out the chip. The mask plate is fixed, while the guide plate is moved into a registration position during insertion of the ballot card. The openings in the mask plate and guide plate are sufficiently large to permit passage of the punch sleeve.

While the above-described vote recorders of the non-scored ballot type eliminate the hanging chad problem, they introduce another difficulty of a somewhat different type. During the tally process one edge of the ballot (the edge at that end of the ballot which is remote from the registration apertures) is positioned against a registration surface in the ballot reader. While the ballot is in that is position radiation (usually infrared radiation) is transmitted through the punched holes for sensing by accurately positioned radiation sensors. In order for the sensors to receive the radiation and correctly record the vote, the punched holes must be accurately positioned relative to the end of the ballot. In contrast to pre-scored ballots the punched holes in non-scored ballots may be located at any position permitted by tolerance errors within the vote recorder. Those errors are critically dependent upon the distance between the registration pins and the openings in the punch plate. Also the distance between the registration edge of the ballot and the regions to be punched is likewise critical. This latter distance depends upon the positioning of the registration apertures relative to the registration edge of the ballot. Thus it is necessary to provide ballot cards having precisely positioned registration apertures in order to assure the required punching accuracy. This increases the cost of the ballot cards as well as the cost of the vote recorder. Moreover, even if registration pins and registration apertures are positioned with a fair degree of accuracy, an out-of-tolerance condition may be caused by flexing and compression of the ballot card.

Prior art recorders for non-scored ballots have an additional problem caused by the need for close control of the movement of the stylus through the overlying templates and into working relationship with the punch plate. In order to achieve such movement control it is necessary to machine the template openings to very small tolerances so as to allow only a very minimal clearance for passage of the stylus. This adds to the cost and creates a tight fitting condition which presents difficulty for the voter. When the voter inserts the punch into the recorder he must align the axis of the punch with the axis of the selected opening. If the clearance between the punch is great enough to ease the punching operation, then any side pressure on the punch will displace the punch tip from the center of the punch plate opening and increase the punching effort or prevent punching altogether.

SUMMARY OF THE INVENTION

The present invention provides an improved punch-type vote recorder and a subcombination thereof for use with a machine-readable, non-scored ballot card. A vote recorder in accordance with this invention is provided with a card block mounted in fixed relation with a punch plate and bias means for biasing the foot of a ballot card into registration against the card block. The punch plate has die openings which are positioned relative to the card block in the same manner as the positioning of the photocells relative to the registration surface in a corresponding ballot reader.

In preferred embodiment the invention employs a ballot holder comprising a guide plate and a punch plate which are joined together as a removable unit and spaced apart to define a ballot card passage. The punch plate is provided with a pattern of die openings in alignment with a similar pattern of guide passages in the guide plate. The die openings have a diameter suitable for passing a punch tip while cooperating therewith to shear a chip from a ballot card residing within the ballot card passage. The guide passages are configured for receiving a punch sleeve telescopically supporting a punch tip and guiding the punch tip into working relationship with one of the die openings in the punch plate.

Further in accordance with this invention, the vote recorder in preferred embodiment has a frame and slide means within the frame for receiving and slidably supporting the ballot holder. Spring means are provided for urging the ballot holder toward a lockout position. A card block is provided inside the ballot holder for engaging and registering the foot of a ballot card which has been inserted into the ballot card passage, and responding to movement of the ballot card by causing sliding movement of the ballot holder against the spring means. The vote recorder has a fixed mask plate which is provided with a pattern of access openings, and these openings are brought into alignment with the guide plate passages when the ballot card has been fully inserted within the vote recorder. This enables insertion of a stylus punch to begin the voting process, during which the foot of the ballot is registered against the card block.

In the preferred embodiment the punch plate of this invention is provided die openings which are produced by a punching and grinding operation. This results in sharp raised cutting edges which are both efficient and economical. Further in preferred embodiment the guide passages in the guide plate are tapered inwardly to facilitate insertion and centering of the punch tip carried by the stylus.

It is a feature of this invention that the registration pins on the vote recorder and the registration apertures in the ballot card become mere positioning pins and positioning apertures without any particularly significant accuracy requirement.

In an alternative embodiment of the invention the positioning pins are replaced by a retractable barricade having a pusher skirt, and the positioning apertures are replaced by a triangular opening. This modification reduces the compressive forces within the ballot card and further improves the punching accuracy.

It is accordingly an object of this invention to provide an improved punch-type vote recorder for use with a machine-readable non-scored ballot card.

A further object of the invention is to provide an improved punch-type vote recorder having no need for precisely positioned registration pins.

Another object of the invention is to enable accurate punching of non-scored and easily produced ballot cards.

Yet another object of the invention is to reduce the compression force on a ballot card and thereby improve the punching accuracy of the recorder.

A still further object of the invention is to provide a punch-type vote recorder device having an improved cutting surface for cutting out chips from a ballot card.

Other objects and advantages of the invention will be apparent from the following description, the accompanying drawings, and the appended claims.

DESCRIPTION OF THE PREFERRED EMBODIMENT

Figure 1:
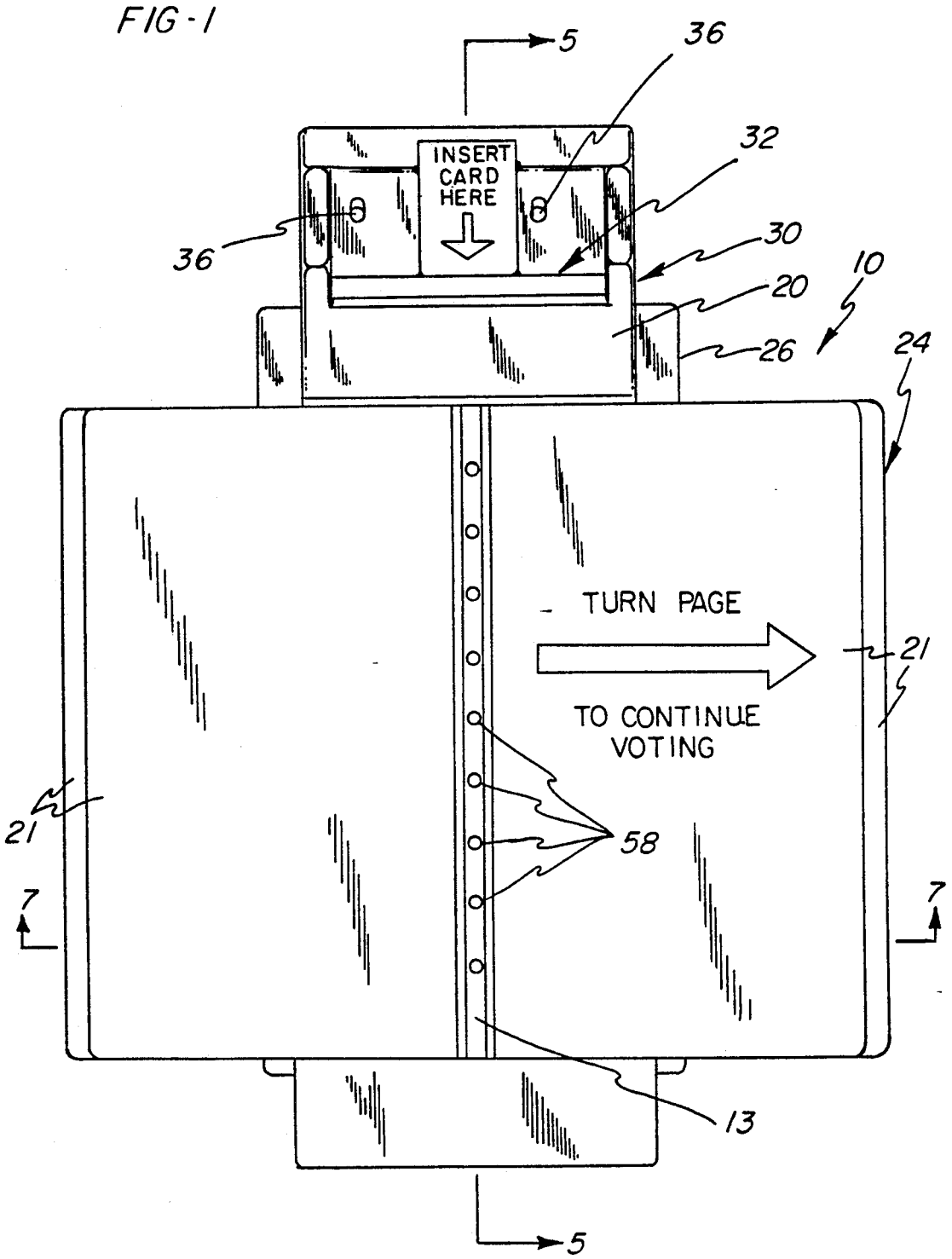
FIG. 1 is a top plan view of a vote recorder of the present invention.

Referring to FIGS. 1 through 9, a punch-type vote recorder 10 for recording votes on a non-scored ballot card 12, is illustrated as comprising a base 14 and a page frame 24 of the type disclosed in Harris U.S. Pat. No. 3,240,409. Page frame 24 supports a series of information bearing leaves 21, called ballot pages, carried by hinge wires (not illustrated) and has a mask plate 23, provided with a series of access openings 58. Mask plate 23 rests on top of a guide plate 50.

Figure 7:
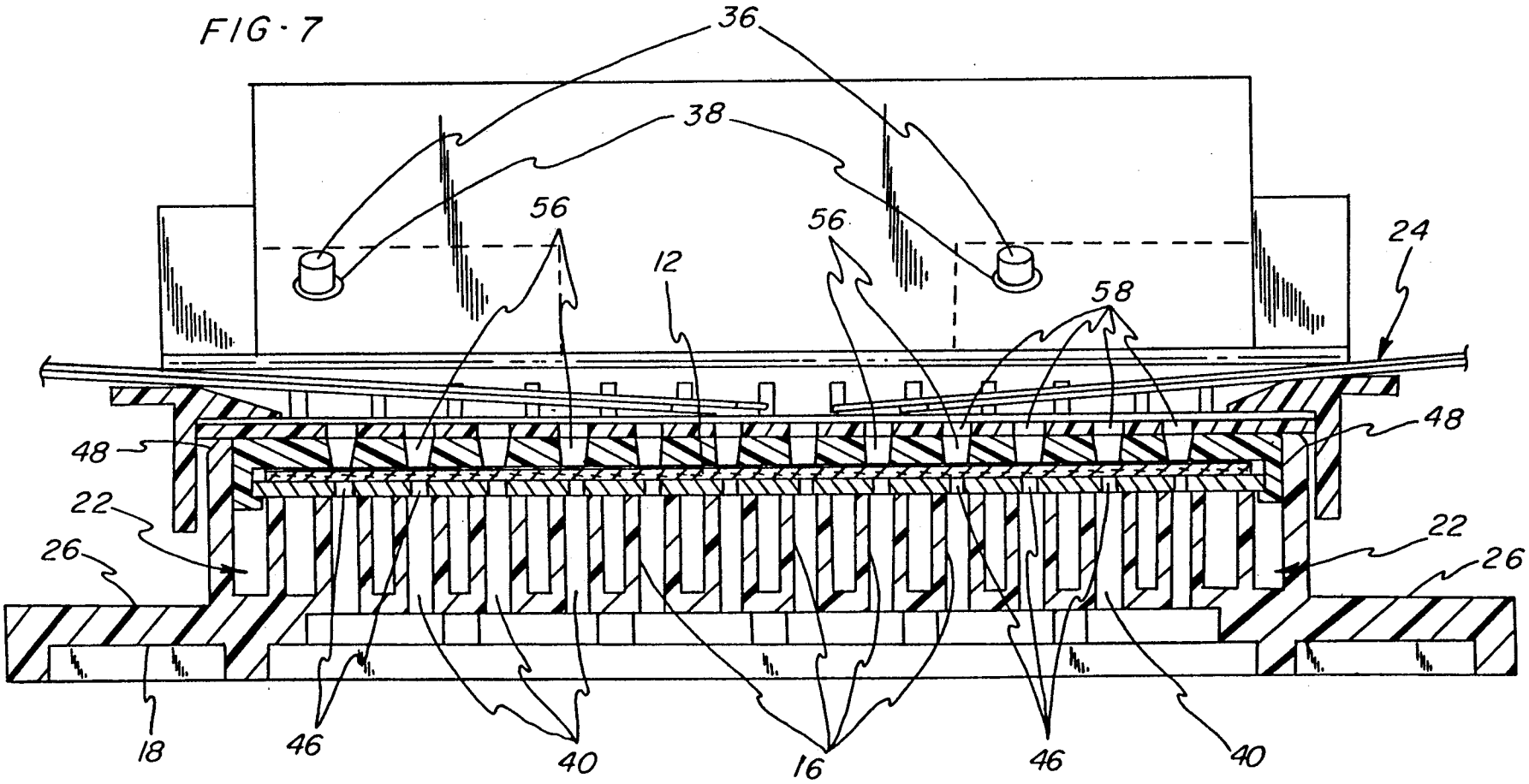
FIG. 7 is an enlarged cross-sectional end view of the vote recording device taken along lines 7—7 of FIG. 1.
Figure 8:
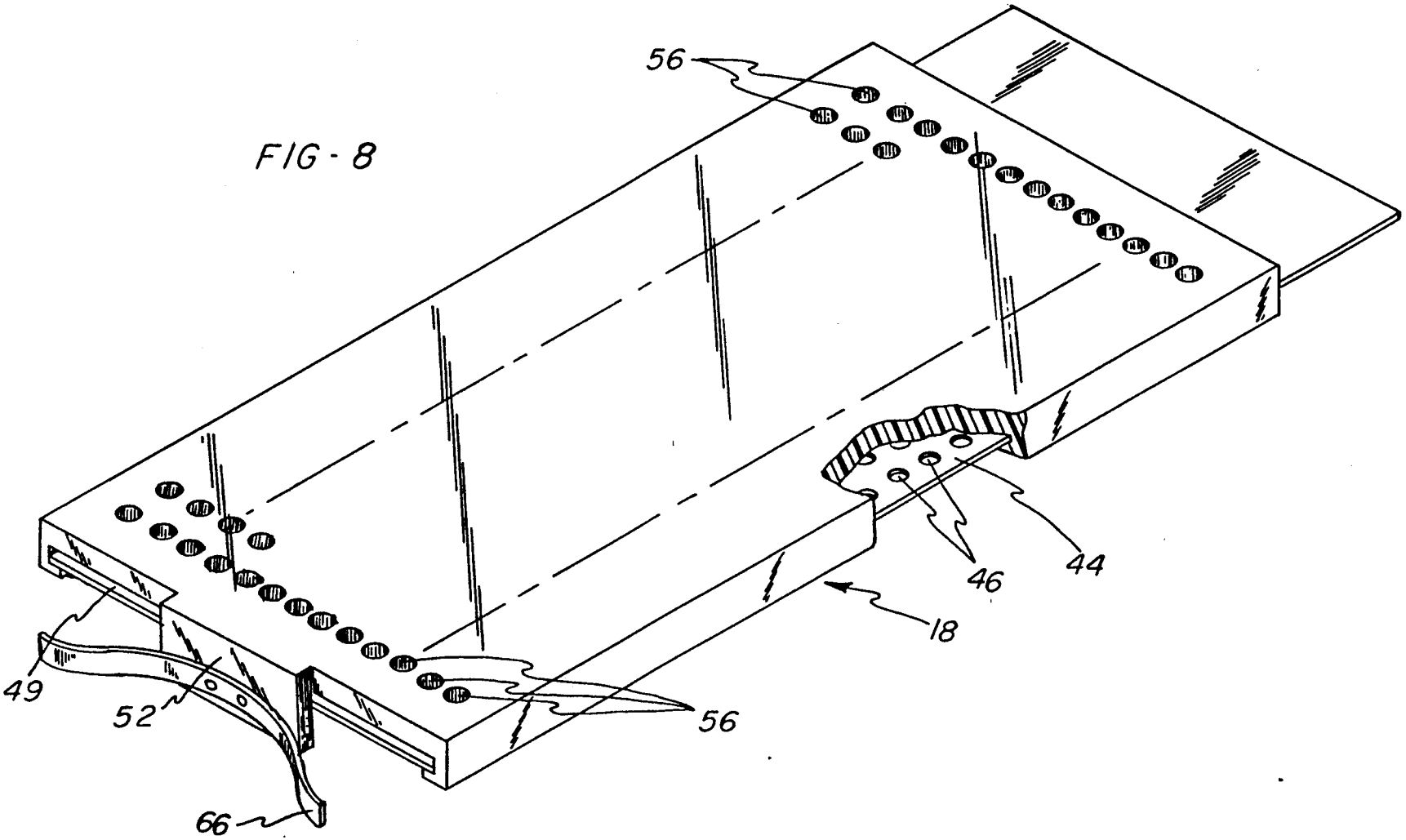
FIG. 8 is a partially cut-away perspective view of the ballot holder.

Base 14 comprises a plurality of support ribs 16 for supporting a ballot holder 18 (FIG. 8), a pair of longitudinally extending side members 22 for supporting page frame 24, a flange member 20 for securing page frame 24, and a pair of elongated flanges 26. As shown in FIG. 7, a series of channels 40 are provided between support ribs 16 for accommodating the chips punched or cut out of the ballot card 12. A plurality of mounting apertures 28 are provided in flange 26 for securing base 14 to a flat surface (not shown).

Vote recorder 10 has a head 30 which is provided with a card guide assembly 32 having a longitudinally directed slot 34, for receiving ballot card 12. Ballot card 12 is preferably non-scored and may be provided with a pair of positioning apertures 38,38 (not precisely positioned) for engagement with positioning pins 36,36 (again, not precisely positioned). Alternatively, as hereinafter described, with reference to FIGS. 10–14, ballot card 12 may be provided with a single triangular opening 201 for engagement by a barricade 250.

The ballot holder 18 rests upon ribs 16 and slides between side members 22 as shown by arrows 42. Ballot holder 18 comprises a guide plate 50 having a pair of downwardly depending sidewalls and a series of guide passages 56. A punch plate 44 having a plurality of die openings 46 therein, is secured to sidewalls 48 in such a manner as to put die openings 46 in alignment with guide passages 56. Guide plate 50 and punch plate 44 are relatively positioned so as to define a ballot card passage 49 therebetween of sufficient size to permit the easy insertion of ballot card 12. Access into ballot card passage is afforded by an entryway 97. The height of ballot card passage 49 is minimized so as to improve the alignment of die openings 46 and guide passages 56. Preferably this height is about 2 to 3 times the thickness of ballot card 12. Thus for an election using 0.007 inch thick ballot cards, vote recorder 10 may use a ballot holder 18 having a ballot card passage 49 which is 0.014 to 0.021 inch high.

Figure 9:
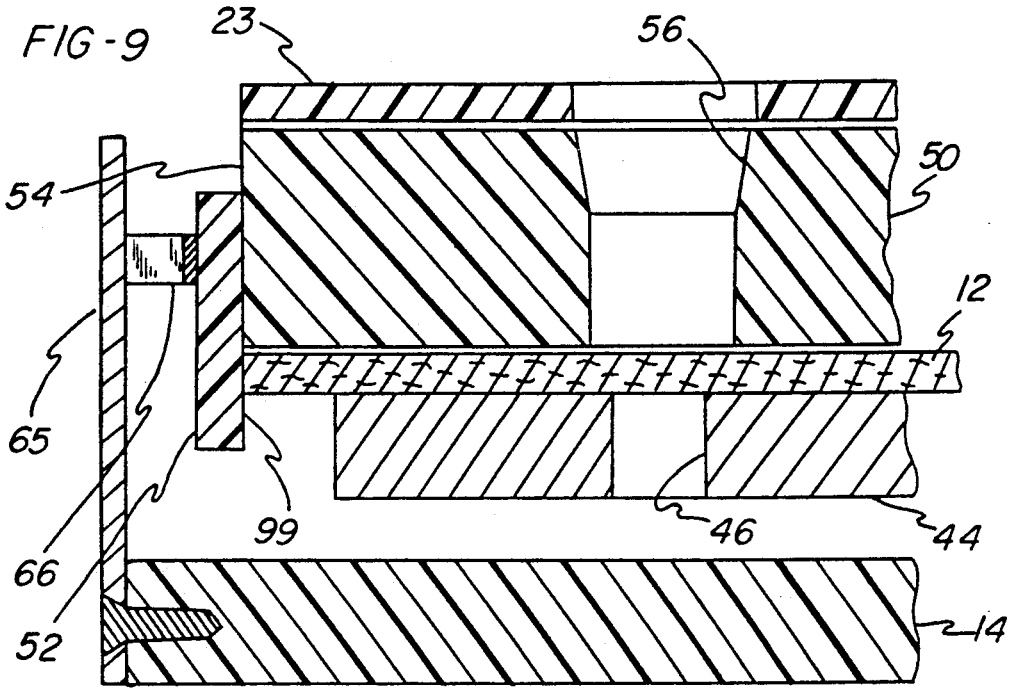
FIG. 9 is an enlarged illustration of the ballot card being registered against a card block.
Figure 10:
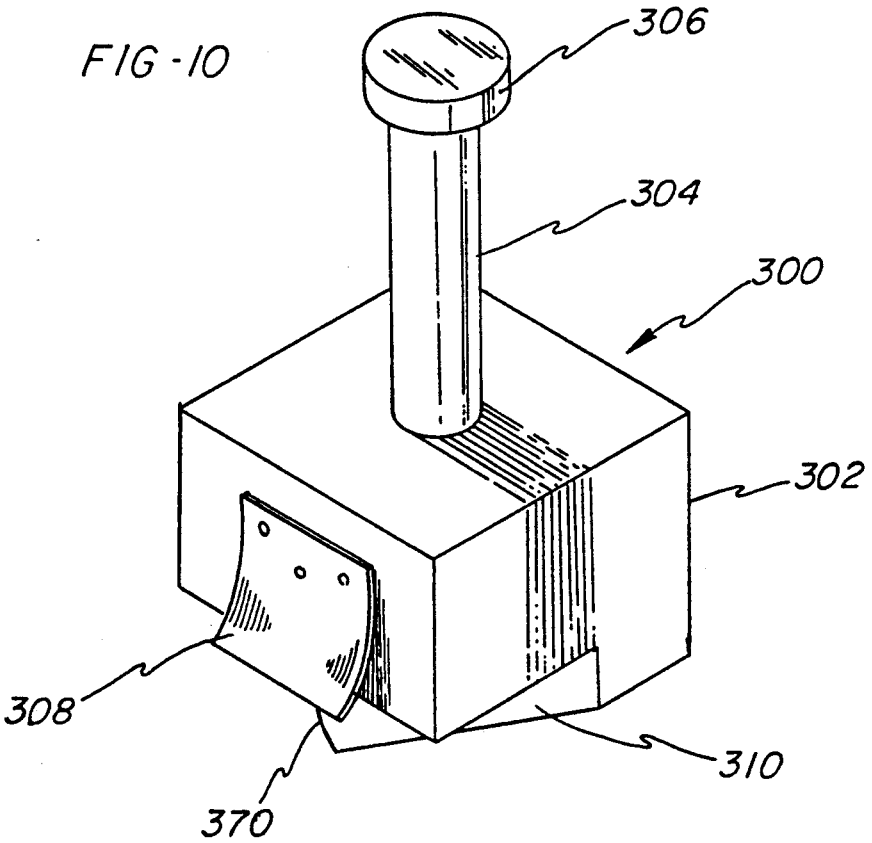
FIG. 10 is an illustration of a barricade for use with an alternative embodiment of the invention.

Guide plate 50 has a downwardly extending flange or card block 52 rigidly secured to its distal face 54 for registration of ballot card 12 when in the "voting" position (See FIG. 9). Even though ballot holder 18 undergoes a sliding movement within vote recorder during insertion and withdrawal of a ballot card, it will be appreciated that the position of card block 52 is at all times fixed relative to punch plate 44. Furthermore, card block 52 is located opposite entryway 97 to define an endwall for ballot card passage 49 and is provided with an inwardly facing registration surface 99. The positioning of registration surface 99 relative to die openings 46 corresponds to the positioning of a ballot reader registration surface (not illustrated) relative to its associated ballot-reading photocells. This minimizes reading errors during the tally process. A leaf spring 66 is mounted upon the outer face of card block 52 for biasing card block 52 against the foot of the ballot card.

As ballot card 12 is inserted into vote recorder 10, it slides through entryway 97, enters ballot card passage 49, and eventually engages registration surface 99 of card block 52. At this point continuing insertion pressure upon the ballot card moves ballot holder 18 forwardly, forcing leaf spring 66 to compress against an abutment plate 65 secured fast within vote recorder 10. This in turn produces a reaction force against the foot of ballot card 12. When the positioning apertures 38,38 at the head of ballot card 12 are in alignment with positioning pins 36,36, the voter slips the card over the pins to complete the insertion sequence. The foot of ballot card 12 is then in registration with die openings 46 in punch plate 44. Furthermore guide passages 56 are then in alignment with access openings 58 of mask 23, so that a stylus may be fully inserted into the vote recorder.

Figure 2:
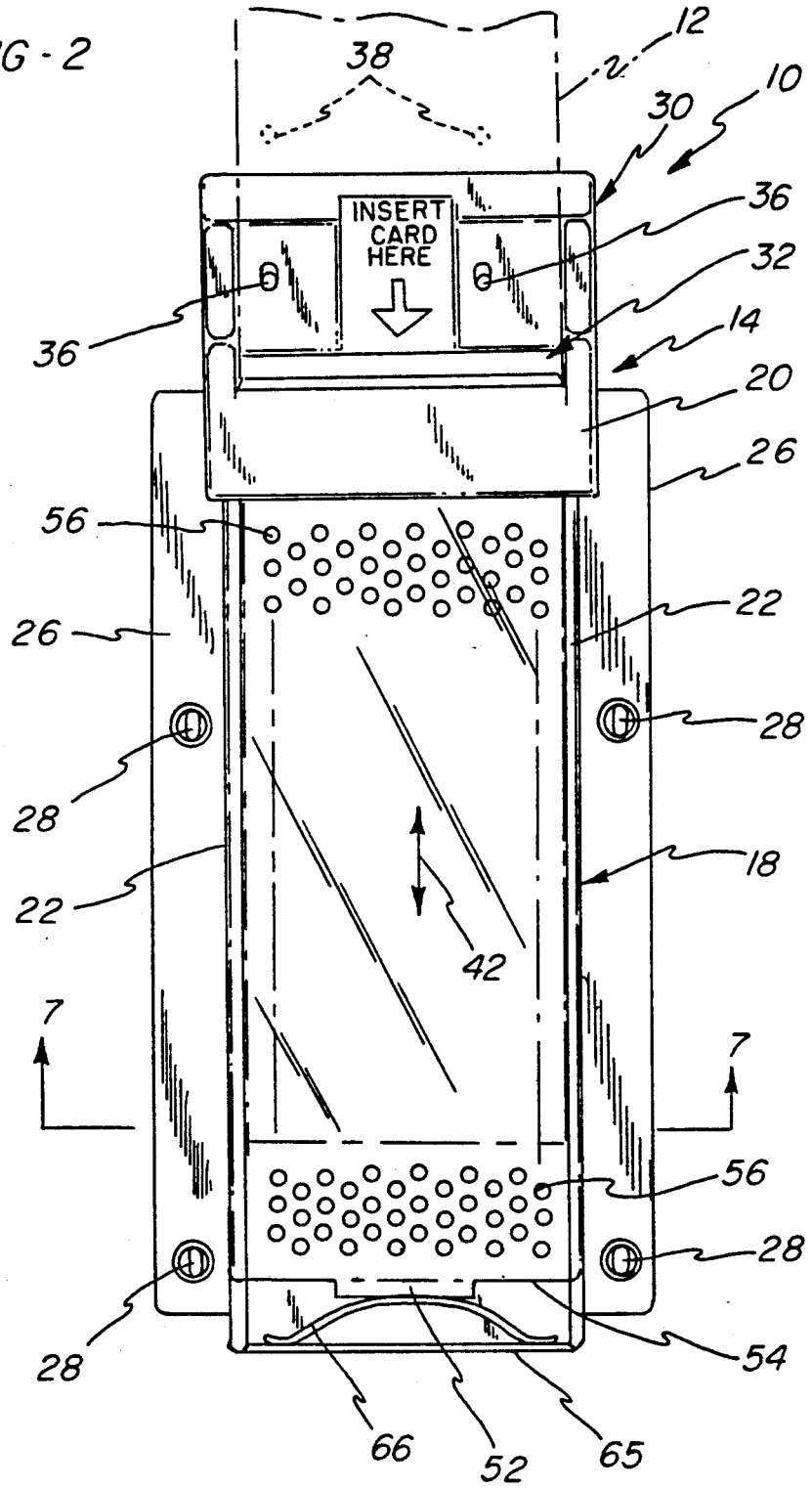
FIG. 2 is a top plan view of the vote recorder of FIG. 1 in the rest position showing the ballot card in phantom and with the mask plate removed for clarity.
Figure 3:
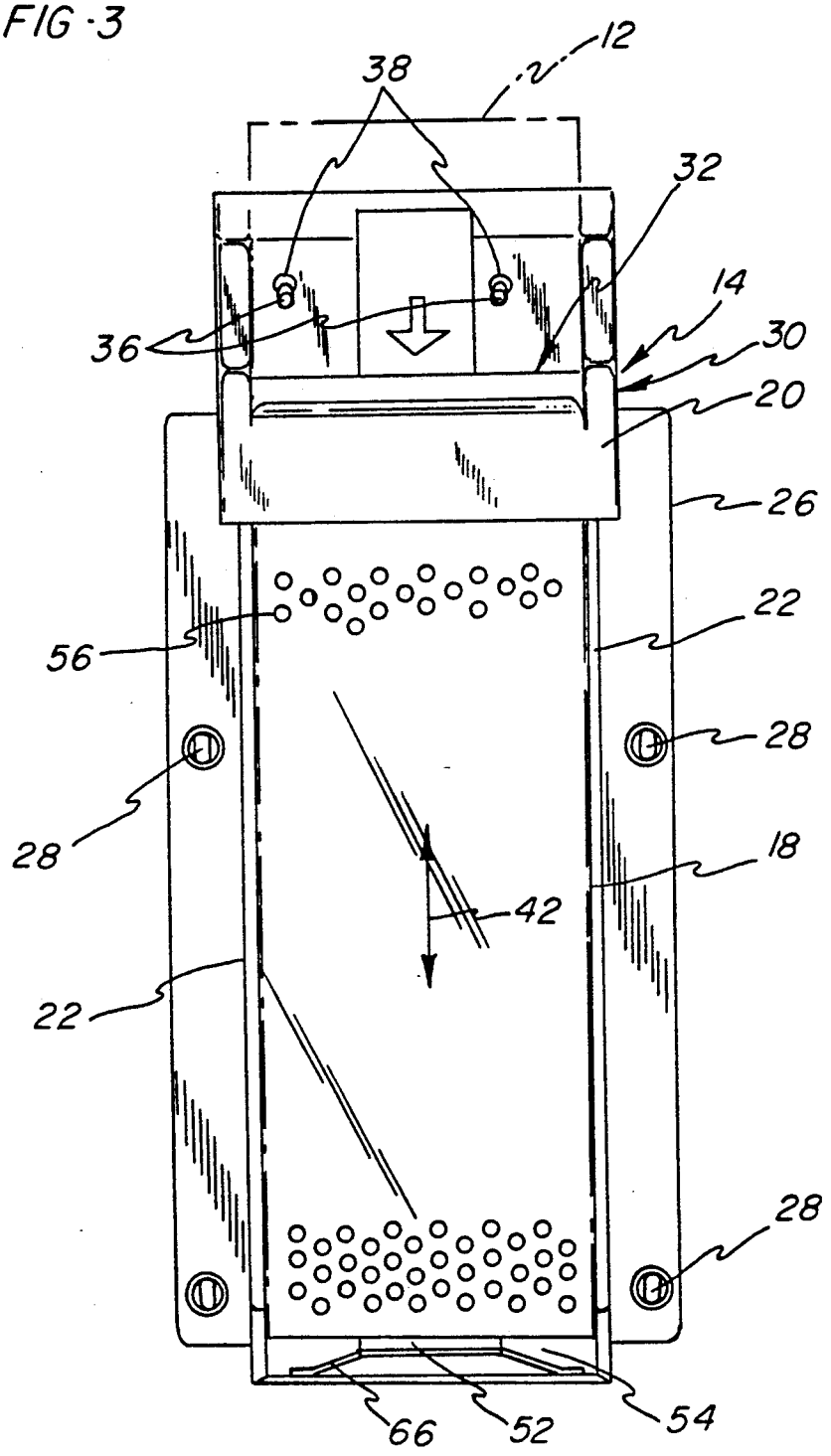
FIG. 3 is a top plan view of the vote recorder of FIG. 1 in an operative position showing the ballot card in phantom and with the mask plate removed for clarity.
Figure 4:
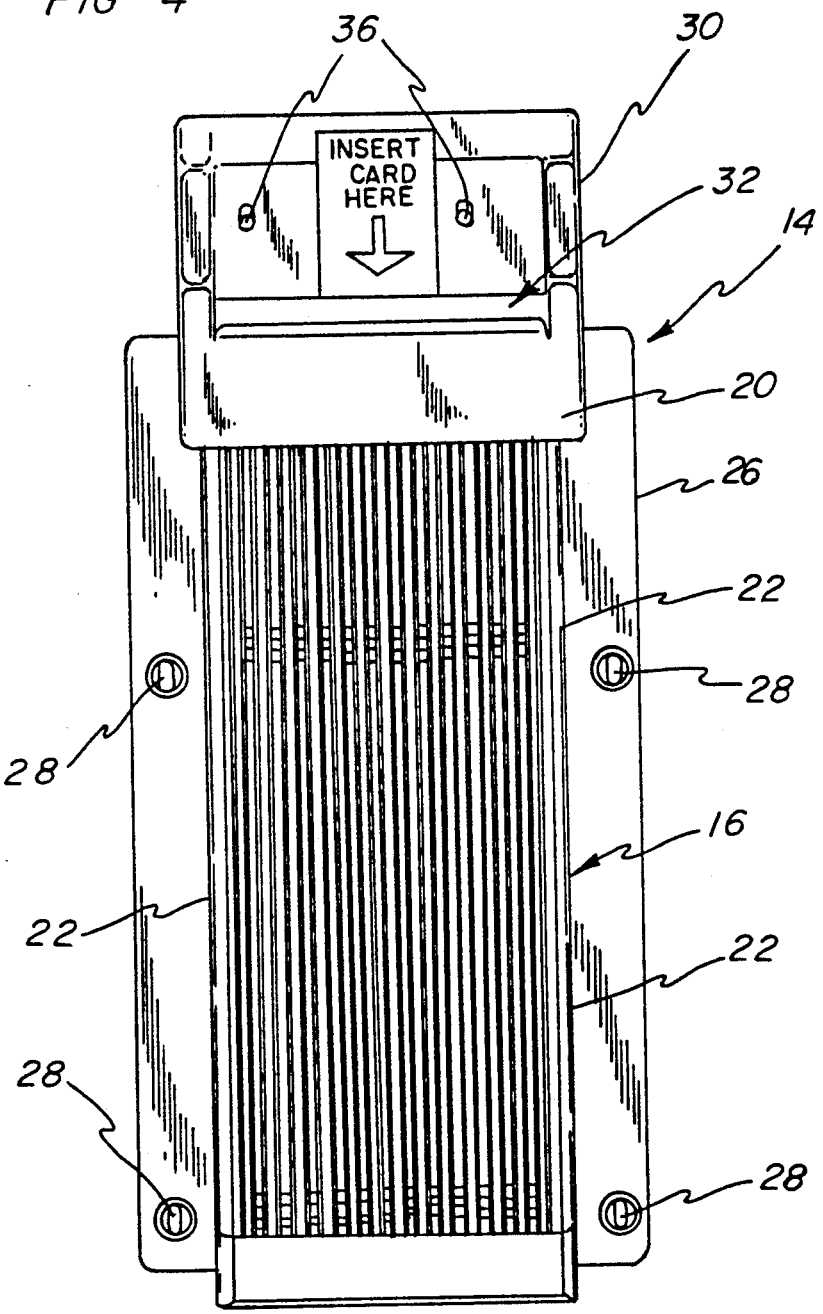
FIG. 4 is the top plan view of the vote recorder of FIG. 1 with the mask plate and ballot holder removed.
Figure 5:
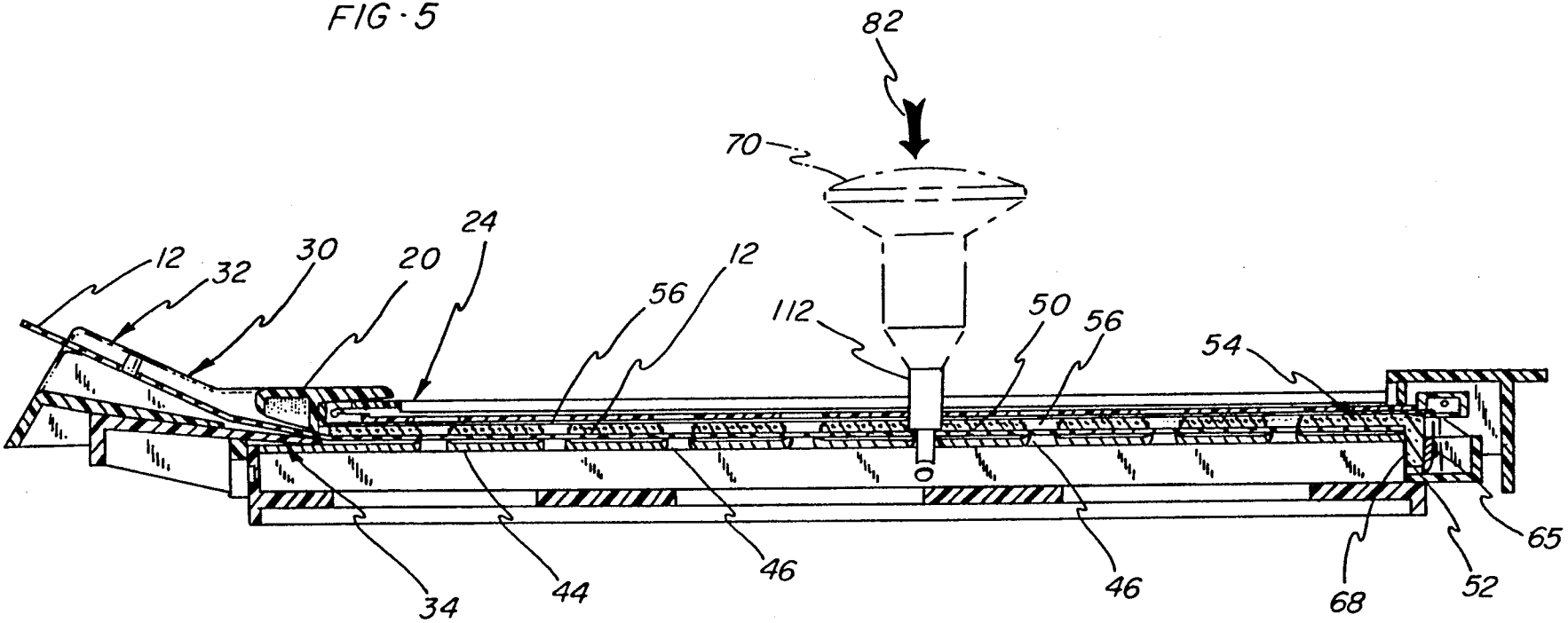
FIG. 5 is a cross-sectional view of the vote recorder taken along lines 5—5 of FIG. 1, showing the punching stylus, in phantom.

Normally, with no ballot card in vote recorder 10, leaf spring 66 urges ballot holder 18 toward a retracted, lockout position wherein guide passages 56 in the guide plate 50 are out of alignment with access openings 58 in mask plate 23. FIG. 2 illustrates ballot holder 18 in the lockout position. FIGS. 3 and 5 illustrate the voting position wherein the guide passages 56 are in alignment with access openings 58.

It should now be clear that the use of card block 52 for registration of ballot card 12 eliminates the criticality in the location of positioning pins 36 relative to die openings 46, and the criticality of the location of positioning apertures 38 in the ballot card 12. Thus, the frame 14 can be manufactured using relatively inexpensive conventional plastic molding techniques, and the assembly parts between the registration pins 36 and punch plate 44 do not require individualized machining. In contrast it is relatively easy to achieve accurate positioning of card block 52 in ballot holder 18. For instance, ballot holder 18 may be assembled and then placed in a suitable jig for a simple machining step wherein die openings 46 are used as a reference to machine the registration surface 99 of card block 52 to the correct location.

Figure 6:
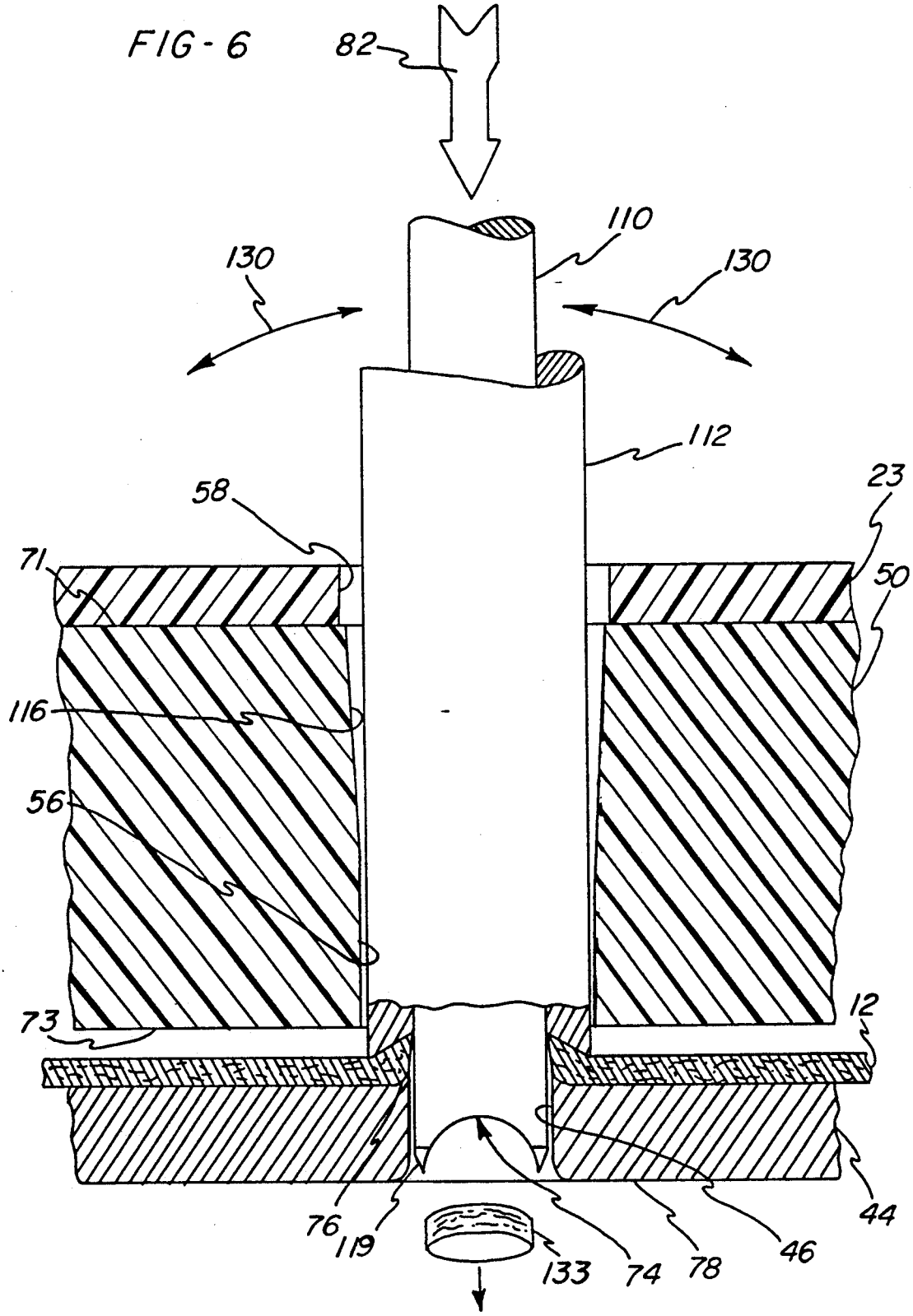
FIG. 6 is an enlarged fragmentary cross-sectional view of the vote recording device illustrating the insertion and operation of a stylus.
Figure 15:
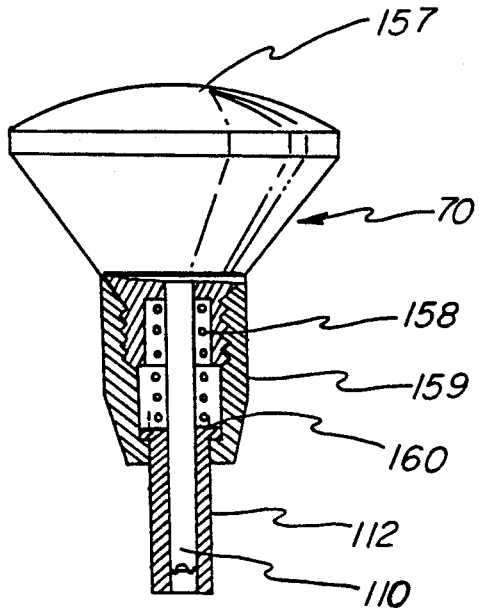
FIG. 15 is a side elevation view of a ballot punch.

In operation the user, after properly inserting the ballot card 12 into the ballot holder 18 and locating the positioning apertures 38 about the positioning pins 36 to lock the card 12 in its fully inserted position, inserts the end of the stylus 70 (FIG. 5) downwardly through the openings 58 and 56 in the mask 23 plate and the punch guide 50, respectively, to record his vote. Stylus 70 is provided with a telescopic sleeve 112 surrounding a punch shaft 110, as best illustrated in FIG. 15. The access openings 58 in mask plate 23 are slightly larger than guide passages 56. This feature is designed to facilitate the entry of the telescopic sleeve 112 into guide plate 50 (FIG. 6). Guide passages 56 are inwardly tapered as at 116. This produces a frustoconical shape such that each opening 58 is slightly larger in diameter at the upper surface 71 of the guide plate 50 than at the lower surface 73 thereof. This guides the stylus sleeve toward die opening 46 and centers tip 74 of the punch shaft 110 for the punching sequence. The tapering of the openings 58 also provides some end play, as illustrated by the arrows 130, thereby easing entry of stylus 70 into vote recorder 10 while concomitantly directing punch tip 74 toward the center of die openings 46.

Figure 6A:
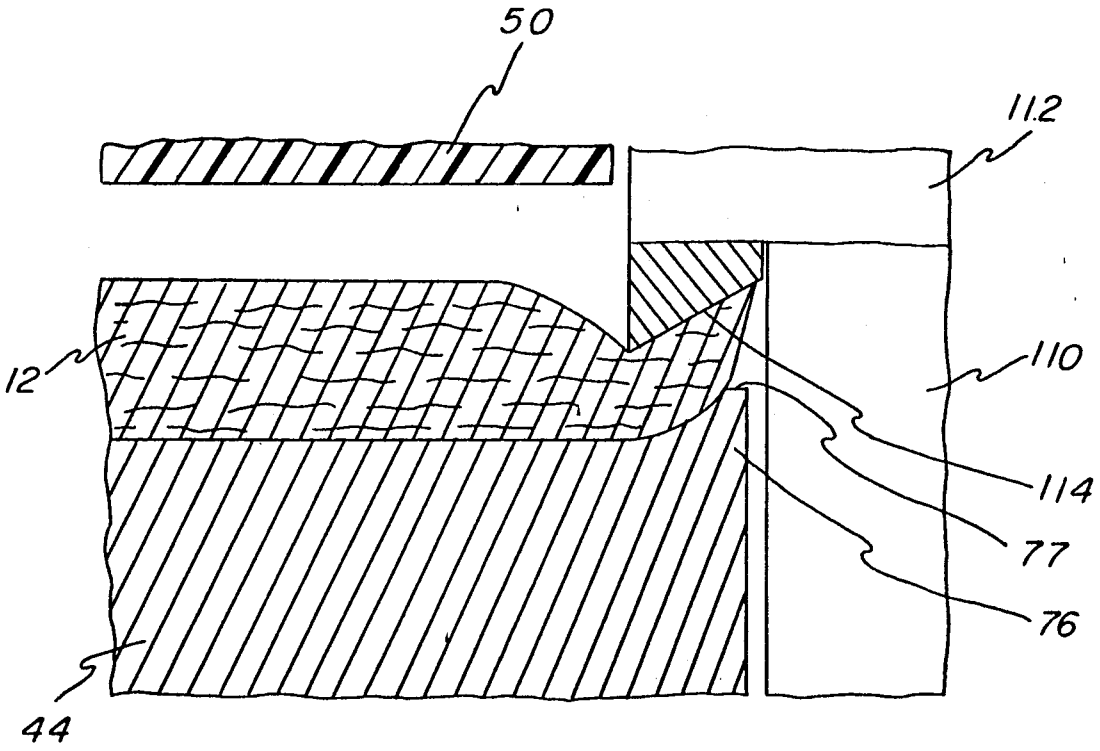
FIG. 6A is a further enlargement of a portion of FIG. 6 illustrating an edge of a die opening in a punch plate.

As best shown in FIG. 6A, each die opening 46 includes an upturned lip 76. Punch plate 44 is produced by a punching process in which a conventional punch is forced through the plate blank from its lower surface 78. This avoids a somewhat more expensive die forming process and produces upstanding lips such as the illustrated lip 76 around the die openings 46. The lips 76 are ground by a conventional grinder to flatten the top surfaces 77 thereof. This sharpens their cutting edges and improve their performance.

After the stylus 70 has been inserted through an access opening 58 and a guide passage 56, respectively, the stylus 70 is axially depressed, in the direction of the arrow 82, causing sleeve 112 to bear against the upper surface of ballot card 12. This clamps the ballot card around the lip 76, while the punch tip 74 continues its downward movement and cooperates with lip 76 to shear out a chip 133 and cut a precise machine-readable circular hole in the ballot card 12. As also illustrated by FIG. 6, the lower surface of sleeve 112 has an inwardly and upwardly bevelled surface 114 for improved clamping of ballot card 12 against lip 76. Additionally the lower end of punch rod 110 may be tapered, as at 119 to improve entry into die opening 46.

Tip 74 of punch rod 110 is preferably ground to produce a cylindrically concave cutting surface of an axially angled orientation for contacting and cutting the ballot card with a progressive cutting action. Preferably, the angle of the cylindrical concavity is such as to produce opposed cutting points which are vertically separated a distance about equal to the thickness of ballot card 12. In a typical case the angle of the cylindrical axis may be about 3 deg. (87 deg. from the axis of punch rod 110). Such tip grinding is known in the art and is employed in styli supplied with EC vote recorders sold by Triad Governmental Systems, Inc. of Xenia, Ohio.

Figure 12:
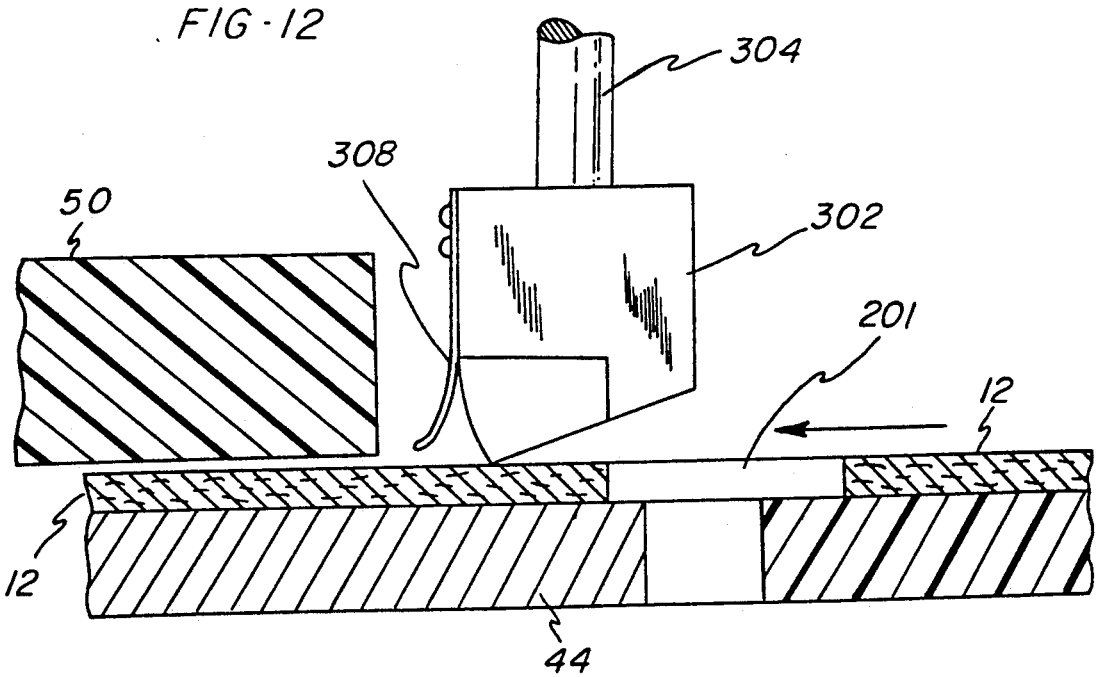
Figure 13:
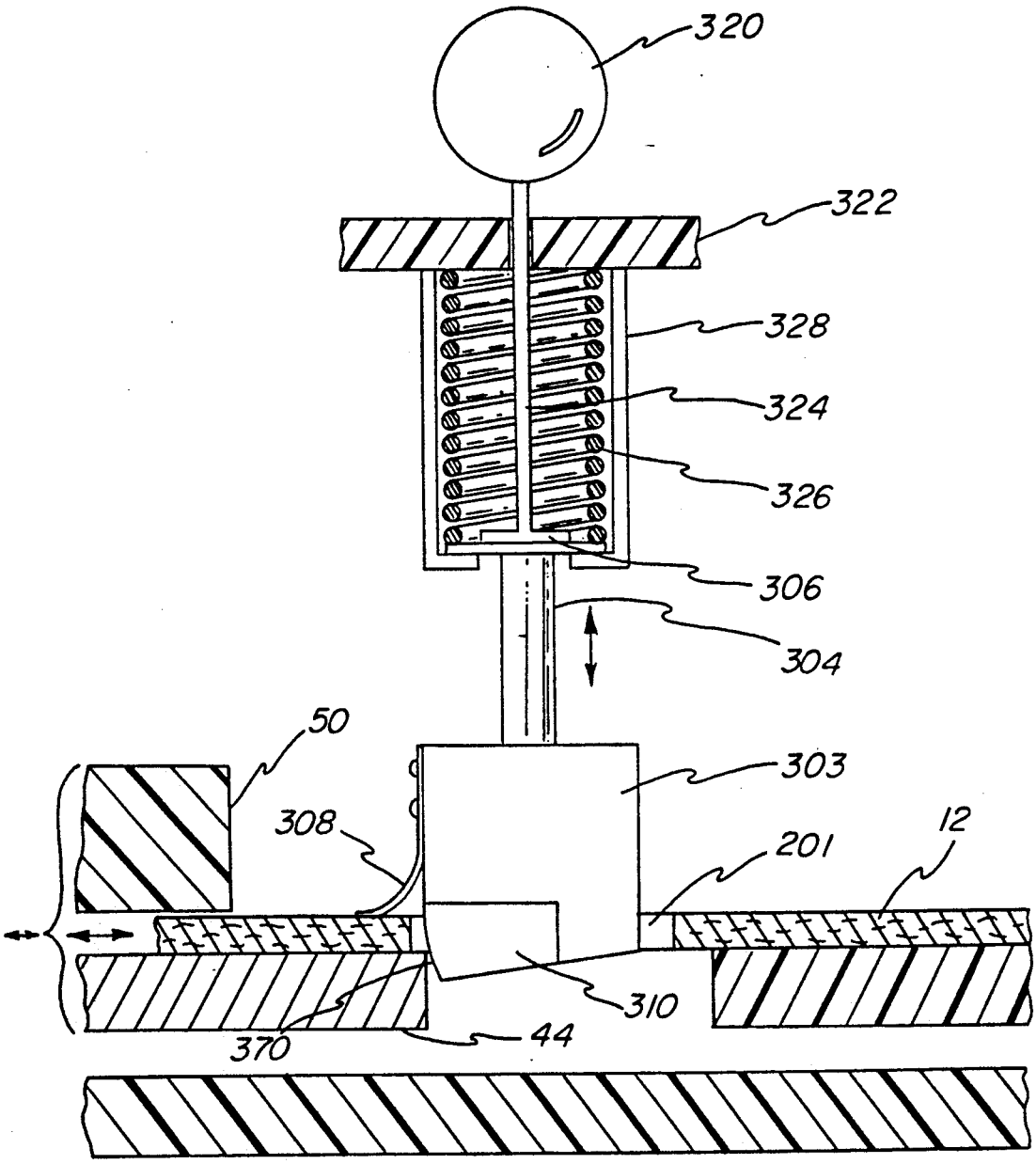
FIG. 13 is an illustration of the barricade of FIG. 10 in its fully activated position.
Figure 14:
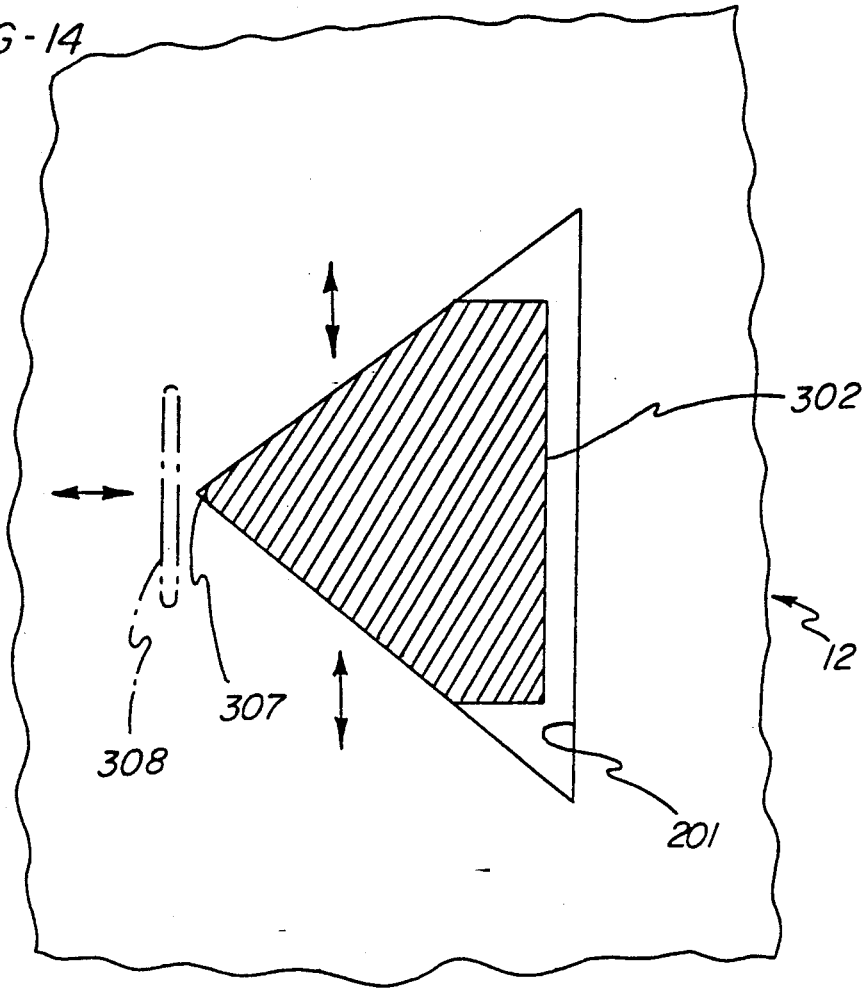
FIG. 14 is a schematic illustration of a barricade in position within a ballot card.

An alternative embodiment of the invention, as illustrated in FIGS. 10–14 comprises a moveable barricade 300 provided with a block 302, a support rod 304 and a flange 306. A flexible skirt 308 is secured to the front face of block 302. Preferably skirt 308 is made from a piece of spring steel having a slight permanent curvature. The lower surface of skirt 308 is coated by a high friction material, such as vulcanized rubber. Block 302 has a slightly curved leading edge 370 and a waist region 310 angles rearwardly from the edge 370 to define a pentagonal cross-section as best illustrated in FIG. 14.

As illustrated in FIG. 13, flange 306 is captured inside a cylindrical housing 328. A compression spring 326 inside housing 328 bears against flange 306, forcing block 302 in the downward direction. Housing 328 is fixed to a bracket 322, which in turn is secured to base 14 of vote recorder 10. An actuator 320 has a plunger 324 which reaches through bracket 322 and into housing 328. The lower end of plunger is secured to flange 306. This enables a voter to raise barricade 300, against the opposing force of spring 326 by pulling upwardly on actuator 320.

In the illustration of FIG. 13 barricade 300 is the "voting" position, and the openings in ballot holder 18 is are in alignment with access apertures 58 of mask plate 23, as described above with reference to the preceding embodiment. However, in the present embodiment barricade block 302 bears against the head end of punch plate 44, thereby resisting the force of leaf spring 66 and reducing the compressive stresses on ballot card 12. This embodiment does not use positioning pins 36. Also ballot card 12 has no positioning apertures 38.

Figure 11:
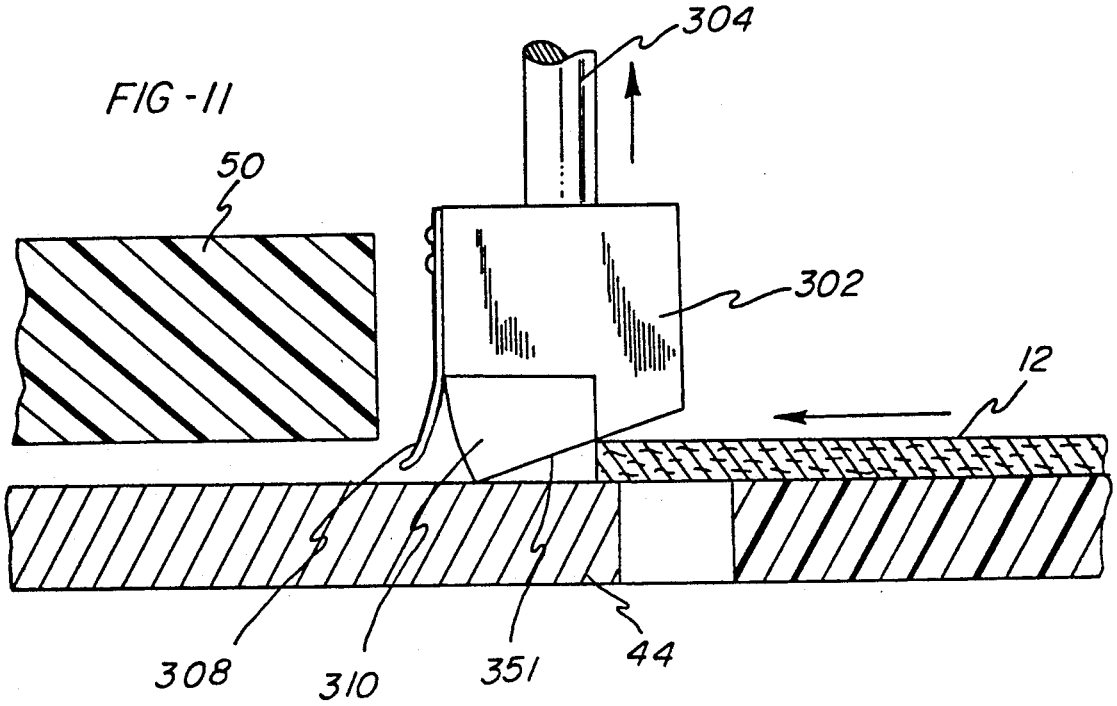
FIGS. 11 and 12 are schematic illustrations of the operation of the barricade of FIG. 10 during insertion of a ballot card into the vote recorder.

When ballot holder 18 is in the lockout position, barricade block 302 bears downwardly against the extending upper surface of punch plate 44, as illustrated in FIG. 11. The lower surface of barricade block 302 is upwardly sloped, as indicated by the reference numeral 351, for engagement by the foot of a ballot card 12. When a ballot card 12 is inserted into vote recorder 10, it engages the surface 351 and raises barricade block slightly for sliding passage thereunder. Barricade block 302 then is positioned as illustrated in FIG. 12.

Ballot card 12 is provided with a triangular opening 201 (FIG. 14) for receiving barricade block 302. After ballot card 12 has been fully inserted into ballot holder 18 and has contacted card block 52, the ballot holder begins its above-described forward movement against the resistance of leaf spring 66. As the forward movement of the ballot holder and the ballot card progresses, the opening 201 comes into alignment with barricade block 302. At this point the spring 326 forces barricade block 302 downwardly into the position illustrated in FIG. 13. Barricade block 302 has a slightly curved leading edge 370 for smoothing out the descent.

Once barricade 300 has dropped into the its lowered position, reverse movement of ballot holder 18 is prevented, and the voter may release the ballot card. It will be appreciated that as soon as barricade 300 begins restraining reverse movement of ballot holder 18, the compressive force of leaf spring no longer acts upon ballot card 12. However it is still necessary to place some small forwardly acting force upon the ballot card to insure registration against card block 52. This force is provided by the skirt 308. As barricade block 302 drops into position, skirt 308 contacts the upper surface of ballot card 12 and flexes upwardly and forwardly. The high friction lower surface of skirt engages ballot card 12 and pushes it forwardly against card block 52 with a slight force, just sufficient to produce the desired registration.

The rearwardly angled waist section 310 of barricade block 302 cooperates with the triangular opening 201 in ballot card 12 to produce left and right centering of the ballot card, as best illustrated in FIG. 14. The side walls of ballot holder 18 preferably have a slight taper (not illustrated) for centering of the foot of the ballot card. This is complemented at the head of the ballot card by the movement of barricade block 302 into the opening 201. When voting has been completed the voter pulls upwardly on the actuator 320 until barricade block 302 clears the opening 201 in ballot card 12. Leaf spring 66 then pushes ballot holder 18 into its normal, rearwardly retracted position, and ballot card 12 may then be pulled out of vote recorder 10. It will be appreciated, however, that the illustration of actuator 320 is merely exemplary and that a wide variety of actuators or toggle devices could be used for producing the desired vertical movement of barricade 300.

Referring now to FIG. 15, stylus 70 differs somewhat considerably from prior art voting styli in its somewhat short and stubby configuration. Preferably the total length of the stylus is no more than about 3 inches. This provides the voter with a sufficient gripping surface while minimizing side play during entry. The relatively short stroke available requires the voter to insert the stylus into the vote recorder in a nearly vertical orientation, thereby improving punching performance.

Stylus 70 comprises a large gripping knob 157, having a lower body portion terminating in a male threaded surface. A boot 159 having a female threaded surface at its upper end is threaded onto knob 157. A compression spring 158 is captured interiorly between knob 157 and boot 159. Telescopic sleeve 112 is fitted inside boot 159, being retained therein by a flange 160 and being forced downwardly thereagainst by spring 158. Punch shaft 110 is permanently secured inside knob 157.

When a voter inserts the sleeve 112 of stylus 70 into an access aperture 58 of mask plate 23, punch shaft 110 is retained within the sleeve. As the insertion continues, sleeve 112 passes through a guide passage 56 and finally comes into contact with ballot 12, forcing it against punch plate 44. Continuing pressure by the voter against knob 157 compresses spring 158, forcing punch tip 74 out of sleeve 112 and downwardly through the ballot.

It will be appreciated that while the slidably mounted ballot holder of the present invention produces substantial advantages, movement of punch plate 44 is not necessary for obtaining the punching accuracy provided by this invention. Punch plate 44 could be fixed, so long as card block 52 is provided in fixed relation to die openings 46 and means are provided for biasing the foot of ballot card 12 against registration surface 99 of card block 52. By way of example and not in limitation, such biasing means could comprise a compression spring at the head 30 of vote recorder 10 biased against a sliding cross-member and a pair of positioning pins such as positioning pins 36 mounted upon the cross-member.

While the forms of apparatus herein described constitute preferred embodiments of this invention, it is to be understood that the invention is not limited to these precise forms of apparatus, and that changes may be made therein without departing from the scope of the invention which is defined in the appended claims.

What is claimed is:

1. In a punch type vote recorder comprising a punch plate provided with a plurality of die openings, each configured for cooperating with a stylus tip to shear a chip out of a ballot card positioned between said stylus tip and said die opening, a guide plate containing a plurality of guide passages for receiving said stylus tip and guiding said stylus tip toward a selected one of said die openings, means for spacing said guide plate apart from said punch plate to define a ballot card passage therebetween and a ballot card entryway at one end of said ballot card passage, and positioning means for positioning a ballot card in said ballot card passage; the improvement wherein said positioning means comprises:

(a) a card block provided with a registration surface for registering an edge of a ballot card positioned in said passage, (b) bias means for maintaining a ballot card in said ballot card passage with an edge thereof biased against said registration surface, and (c) card block mounting means for mounting said card block in fixed relation to said punch plate, so that a ballot which is biased against said registration surface remains in fixed relation to said die openings.

2. The improvement of claim 1 wherein said guide plate is fixed to said punch plate to define a ballot holder, said vote recorder further comprising slide means for enabling sliding movement of said ballot holder, and said bias means comprising spring means for resiliently opposing said sliding movement.

3. The movement of claim 2 wherein said bias means comprises positioning pins mounted in a fixed position on said vote recorder for engaging mating positioning apertures in a ballot card retained within said ballot holder, so that said ballot card resists the action of said spring means.

4. The improvement of claim 1 wherein said guide plate is fixed to said punch plate to define a ballot holder; said vote recorder further comprising slide means for enabling sliding movement of said ballot holder, spring means for resiliently opposing said sliding movement and a retractable barricade for locking said ballot holder in an operative voting position; said bias means comprising means activated in synchronism with said retractable barricade to engage a ballot card positioned within said ballot holder and urge said ballot card toward said registration surface.

5. The improvement of claim 4 wherein said retractable barricade comprises a barricade block for reaching through an opening in a ballot card positioned within said ballot holder and engaging said ballot holder to resist movement of said ballot holder by said spring means.

6. The improvement of claim 5 wherein said bias means comprises a skirt mounted on said barricade block for frictionally engaging an upper surface of a ballot card positioned within said ballot holder.

7. The improvement of claim 5 wherein said barricade block has an angled leading edge for reaching through an opening in a ballot card and centering said ballot card.

8. The improvement of claim 1 wherein said die openings have upturned lips for cooperating with a stylus tip to cut machine-readable openings in a ballot card positioned within said passage.

9. The improvement of claim 8 wherein said lips have been ground to produce sharp cutting edges.

10. A punch type vote recorder comprising:

a frame;

a mask plate secured to said frame and provided with a plurality of access openings for selective insertion of a voting stylus;

a punch plate slidably supported on said frame and having a plurality of die openings arranged for alignment with said access openings when said punch plate has been moved into a predetermined voting position;

a guide plate fixedly secured to said punch plate and having a plurality of guide openings in fixed alignment with said die openings, said punch plate and said guide plate being spaced apart to define a ballot holder having a slot for receiving a ballot card;

a card block secured to said ballot holder for engaging and registering said ballot card;

spring means for resiliently resisting forward movement of said ballot holder when said ballot card is urged against said card block; and lock means for locking said ballot holder in a position such that said access openings, said guide passages, and said die openings are all in alignment.

11. A vote recorder according to claim 10 wherein said die openings have upturned cutting edges for cooperating with a stylus tip to shear precise machine-readable holes in said ballot card.

12. A vote recorder according to claim 10 wherein said guide passages are inwardly tapered for guiding said stylus tip toward a selected one of said die openings.

13. A punch type vote recorder comprising:

a frame;

an elongated punch plate slidably supported on said frame, said punch plate having a plurality of die openings therein;

a card block mounted in fixed relation to said punch plate for sliding movement therewith;

means for guiding a punch tip along a punch path toward a selected one of said die openings;

means for guiding a ballot card into said vote recorder across said punch path for punching by cooperative action between one of said die openings and a punch tip guided theretoward;

spring means for causing sliding movement of said punch plate and said card block in a direction which brings said card block into registering contact with a ballot card guided into said vote recorder as aforesaid, and blocking means selectively resisting said sliding movement.

14. A ballot holder for a punch type vote recorder comprising:

a punch plate provided with a plurality of die openings for cooperating with a punch tip to shear openings in a ballot card positioned above and against said punch plate;

a guide plate provided with a plurality of guide passages for guiding a punch tip toward said die openings;

sidewall means joining said guide plate and said punch plate in fixed parallel relation to define a ballot card passage therebetween and an entryway for a ballot card at one end of said ballot card passage, and a card block mounted on said ballot holder in fixed relation to said punch plate opposite said entryway to provide a registration surface for a ballot card positioned in said ballot card passage.

15. A ballot holder according to claim 14 wherein said die openings have upturned lips facing said guide plate, said lips having been ground to define sharp cutting edges.

16. A ballot holder according to claim 15 wherein said sidewall means comprise sidewalls which are positioned to cause a narrowing of said ballot card passage in a direction from said entryway to said card block, said narrowing being effective for causing centering of a ballot card inserted through said entryway into said ballot card passage.

17. A ballot card holder according to claim 16 wherein said card block is mounted on said guide plate and extends downwardly therefrom toward said punch plate.

18. In a vote recorder;

a punch plate provided with a circular die opening having an upstanding lip and a flat ground upper surface on said lip;

a ballot card positioned against said upper surface;

a punch shaft having a circular cross-section and a lower end provided with a sharp cutting edge for cooperating with said lip to shear a chip from said ballot card, said punch shaft being positioned against said ballot card opposite to and in axial alignment with said die opening, and a telescopic sleeve surrounding said punch shaft and bearing against said ballot card, said telescopic sleeve having an upwardly and inwardly bevelled lower edge for cooperating with said lip to clamp said ballot card therebetween.

19. The improvement of claim 18 wherein said lower end of said punch shaft is tapered to facilitate entry into said die opening.

* * * * *